US006855022B2

(12) United States Patent
Matsuda et al.

(10) Patent No.: US 6,855,022 B2
(45) Date of Patent: Feb. 15, 2005

(54) PERSONAL WATERCRAFT

(75) Inventors: Yoshimoto Matsuda, Kobe (JP); Yasuo Okada, Akashi (JP); Atsufumi Ozaki, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/661,122

(22) Filed: Sep. 11, 2003

(65) Prior Publication Data

US 2004/0082236 A1 Apr. 29, 2004

(30) Foreign Application Priority Data

Sep. 12, 2002 (JP) ..... 2002-266580

(51) Int. Cl.[7] ..... B63H 21/38
(52) U.S. Cl. ..... 440/89 R; 440/89 F; 440/89 J
(58) Field of Search ..... 440/89 R, 89 E, 440/89 F, 89 J, 89

(56) References Cited

U.S. PATENT DOCUMENTS 5,699,749 A * 12/1997 Yamada et al. ..... 114/55.51
6,206,741 B1 * 3/2001 Matsuda ..... 440/89 R
6,290,557 B1 * 9/2001 Yokoya ..... 440/89 R
6,688,929 B2 * 2/2004 Lecours et al. ..... 440/89 R

FOREIGN PATENT DOCUMENTS

JP 3290037 * 3/2002

* cited by examiner

*Primary Examiner*—Sherman Basinger
(74) *Attorney, Agent, or Firm*—Kolisch Hartwell, P.C.

(57) ABSTRACT

A first exhaust chamber and a second exhaust chamber are disposed within a body of a watercraft. The first exhaust chamber communicates with an exhaust port of an engine through a first exhaust pipe. A first space of the first exhaust chamber communicates with the second exhaust chamber through a first inverted-U shaped pipe. The second exhaust chamber communicates with another space of the first exhaust chamber through a second inverted-U shaped pipe. The first and second inverted-U shaped pipes are each positioned in the flow path of the exhaust gas and bent to be substantially inverted-U shaped. The other space of the first exhaust chamber communicates with an outside of the body through a second exhaust pipe. An uppermost portion of the first inverted-U shaped pipe and an uppermost portion of the second inverted-U shaped pipe are located higher than a waterline of the watercraft.

12 Claims, 7 Drawing Sheets

PERSONAL WATERCRAFT

BACKGROUND OF THE INVENTION

1. Field of the Invention

The present invention relates to a jet-propulsion personal watercraft (PWC), and more particularly to an exhaust system of the personal watercraft.

2. Description of the Related Art

In recent years, so-called jet-propulsion personal watercraft have been widely used in leisure, sport, rescue activities, and the like.

The personal watercraft is equipped with an engine mounted in a space within a body, surrounded by a hull and a deck. A water jet pump is driven by the engine to pressurize and accelerate water sucked from a water intake generally provided on a bottom hull surface and eject it rearward from an outlet port. Thereby, the personal watercraft is propelled.

In the jet-propulsion personal watercraft, a steering nozzle is provided behind the outlet port of the water jet pump. By operating a bar-type steering handle either to the right or to the left, the steering nozzle is swung either to the right or to the left, to change the ejection direction of the water to the right or to the left, thereby turning the watercraft to the right or to the left.

A line at which the hull and the deck are connected over the entire perimeter thereof is called a gunnel line. The gunnel line is located slightly above a waterline of the watercraft.

In the above personal watercraft, an exhaust gas from the engine is discharged outside the watercraft through an exhaust pipe via which an exhaust port of the engine and an exhaust outlet provided on the body communicate with each other. A muffler (exhaust chamber) is provided at a location in the exhaust pipe to muffle or improve an exhaust noise of the exhaust gas. In order to further enhance a muffling effect of the exhaust noise of the exhaust gas, the exhaust outlet is typically located below the waterline of the watercraft to allow the exhaust gas to be discharged into the water.

The water jet pump is provided at a rear portion of the hull such that the water jet pump is disposed on a center axis of the body along the longitudinal direction of the body. The water jet pump is surrounded by the hull. Conventionally, the exhaust pipe and the exhaust chamber are disposed in a space within the body either on the right or left side of the water jet pump. In recent years, to improve a muffling function and a weight balance of the watercraft, there has been adopted an exhaust system in which the exhaust chamber is divided into two parts in a flow path of the exhaust gas, i.e., an upstream chamber and a downstream chamber arranged on the right and left sides of the water jet pump.

Conventionally, the exhaust pipe, located downstream of the exhaust chamber in the flow path of the exhaust gas, extends substantially in the shape of a straight line from a rear end portion of the exhaust chamber to the exhaust outlet. As disclosed in Japanese Patent Publication No. 3290037, the exhaust outlet of the body, the exhaust pipe, and a portion where the exhaust pipe and the exhaust chamber are connected to each other, are typically located below the waterline of the watercraft.

In the conventional exhaust system having the above configuration, water outside the watercraft enters through the exhaust outlet and easily flows into the exhaust chamber through the exhaust pipe with the engine being in a stopping state without flow of the exhaust gas.

The water flowing into the exhaust chamber sometimes flows into an inside of an engine body during the stopping state of the engine. The water remaining within the exhaust chamber causes a pressure (back pressure) of the exhaust gas to tend to increase when the exhaust gas is discharged during start of the engine. Such a condition is undesirable to the engine.

SUMMARY OF THE INVENTION

The present invention addresses the above described conditions, and an object of the present invention is to provide a small watercraft capable of minimizing entry of water into an exhaust chamber.

According to the present invention, there is provided a personal watercraft comprising a body formed by joining a hull and a deck, an engine mounted within the body, a first exhaust chamber disposed on one side of the body, the first exhaust chamber having a plurality of inner spaces defined by at least one separating wall to allow an exhaust gas from the engine to flow within the inner spaces, a second exhaust chamber disposed on an opposite side of the body to allow the exhaust gas from the first exhaust chamber to flow within the second exhaust chamber, a first exhaust pipe through which the engine and the first exhaust chamber communicate with each other such that the exhaust gas from the engine is drawn into one of the inner spaces of the first exhaust chamber through the first exhaust pipe, a first inverted-U shaped pipe configured to extend from the first exhaust chamber to the second exhaust chamber such that the exhaust gas drawn into the first exhaust chamber through the first exhaust pipe is drawn from the first exhaust chamber to the second exhaust chamber through the first inverted-U shaped pipe, a second inverted-U shaped pipe configured to extend from the second exhaust chamber to the first exhaust chamber such that the exhaust gas drawn into the second exhaust chamber through the first inverted-U shaped pipe is drawn from the second exhaust chamber into another one of the inner spaces of the first exhaust chamber through the second inverted-U shaped pipe, and a second exhaust pipe configured to extend from the first exhaust chamber to an outside of the body such that the exhaust gas drawn into the first exhaust chamber through the second inverted-U shaped pipe is drawn from the first exhaust chamber to the outside of the body through the second exhaust pipe, wherein the first inverted-U shaped pipe and the second inverted-U shaped pipe are each positioned in the flow path of the exhaust gas and bent to be substantially inverted-U shaped.

In the above configuration, since the first exhaust chamber and the second exhaust chamber communicate with each other through the first inverted-U shaped pipe and the second inverted-U shaped pipe, each of which is bent at a position thereof in the flow path of the exhaust gas, the water outside the watercraft is inhibited from flowing into the first exhaust chamber and the second exhaust chamber. As used herein, the term "inverted U-shaped" means bent or curved downwardly.

The second inverted-U shaped pipe may be connected to the first exhaust chamber so as to protrude into the other one of the inner spaces of the first exhaust chamber. In this configuration, when the body of the watercraft is inclined and water flows into the other one of the inner spaces of the first exhaust chamber through the second exhaust pipe, the water is inhibited from flowing from the inner space into the second exhaust chamber through the second inverted-U shaped pipe.

In addition, when a downstream end portion of the first inverted-U shaped pipe is configured to protrude into the second exhaust chamber and a downstream end portion of the first exhaust pipe is configured to protrude into the first exhaust chamber, the water within the second exhaust chamber and the water within the first exhaust chamber are inhibited from flowing to upstream side. Therefore, entry of water into the engine body is effectively inhibited.

An uppermost portion of the first inverted-U shaped pipe and an uppermost portion of the second inverted-U shaped pipe may be each located higher than a waterline of the body of the watercraft. In this configuration, entry of the water into the first exhaust chamber and the second exhaust chamber are inhibited in a more reliable manner.

The first exhaust chamber and the second exhaust chamber may be each comprised of a cylindrical member with a center axis thereof extending in a longitudinal direction of the body. In this case, the first exhaust chamber and the second exhaust chamber can be arranged in the hull and manufactured easily.

The first exhaust chamber and the second exhaust chamber may be connected at peripheral portions thereof to the first inverted-U shaped pipe and the second inverted-U shaped pipe, respectively.

In this structure, the first inverted-U shaped pipe and the second inverted-U shaped pipe can be simply structured in contrast with the case where the first and second inverted-U shaped pipes are connected to end portions of the first and second exhaust chambers, respectively.

At least one of the first exhaust chamber and the second exhaust chamber may form a resonator. With the resonator, the exhaust noise of the exhaust gas from the engine can be effectively reduced.

A front end of the second exhaust chamber may be located behind a front end of the first exhaust chamber within the body.

In this configuration, an open space located forward of the second exhaust chamber is utilized to allow auxiliary equipment or the like of the engine to be arranged therein. For example, a battery may be disposed forward of the second exhaust chamber.

The personal watercraft may further comprise a water jet pump driven by the engine, and the water jet pump may be disposed on a substantially center axis of the body to extend along a longitudinal direction of the body, and the first exhaust chamber and the second exhaust chamber may be disposed on right and left sides of the water jet pump, respectively. In this configuration, the above described effects are obtained, and weight balance on the right and left sides of the body is properly kept.

A valve for inhibiting reverse flow may be provided in the second exhaust pipe. The valve may be provided within one or a plurality of the first exhaust pipe, the first inverted-U shaped pipe, the second inverted-U shaped pipe, and the second exhaust pipe. The valve serves to effectively inhibit the water outside the watercraft from flowing toward the upstream side in flow path of the exhaust gas.

The first inverted-U shaped pipe and the second inverted-U shaped pipe may be provided to extend in a space within the body which is formed above a joint portion where the hull and the deck are joined to each other. In this configuration, an empty space within the body is used to allow the first inverted-U shaped pipe and the second inverted-U shaped pipe to be easily provided. Further, the uppermost portion of the first inverted-U shaped pipe and the uppermost portion of the second inverted-U shaped pipe can be located higher than the waterline of the watercraft.

The personal watercraft may be a straddle-type watercraft provided with a seat straddled by a rider, and may further comprise a rear deck formed at a rear portion of the body, and a storage box disposed forward of the rear deck and under the seat, wherein the space within the body may be located between the rear deck and the storage box, and the first inverted-U shaped pipe and the second inverted-U shaped pipe are configured to extend through the space within the body.

In the straddle-type personal watercraft, the storage box is provided under the seat and the rear deck is provided behind and below the seat. Between the rear deck and the storage box, an open space is formed with the body. Therefore, by using the above configuration, the open space in the personal watercraft having a narrow inner space is effectively utilized.

The above and further objects and features of the invention will more fully be apparent from the following detailed description with accompanying drawings.

DETAILED DESCRIPTION OF THE PREFERRED EMBODIMENTS

Figure 1:
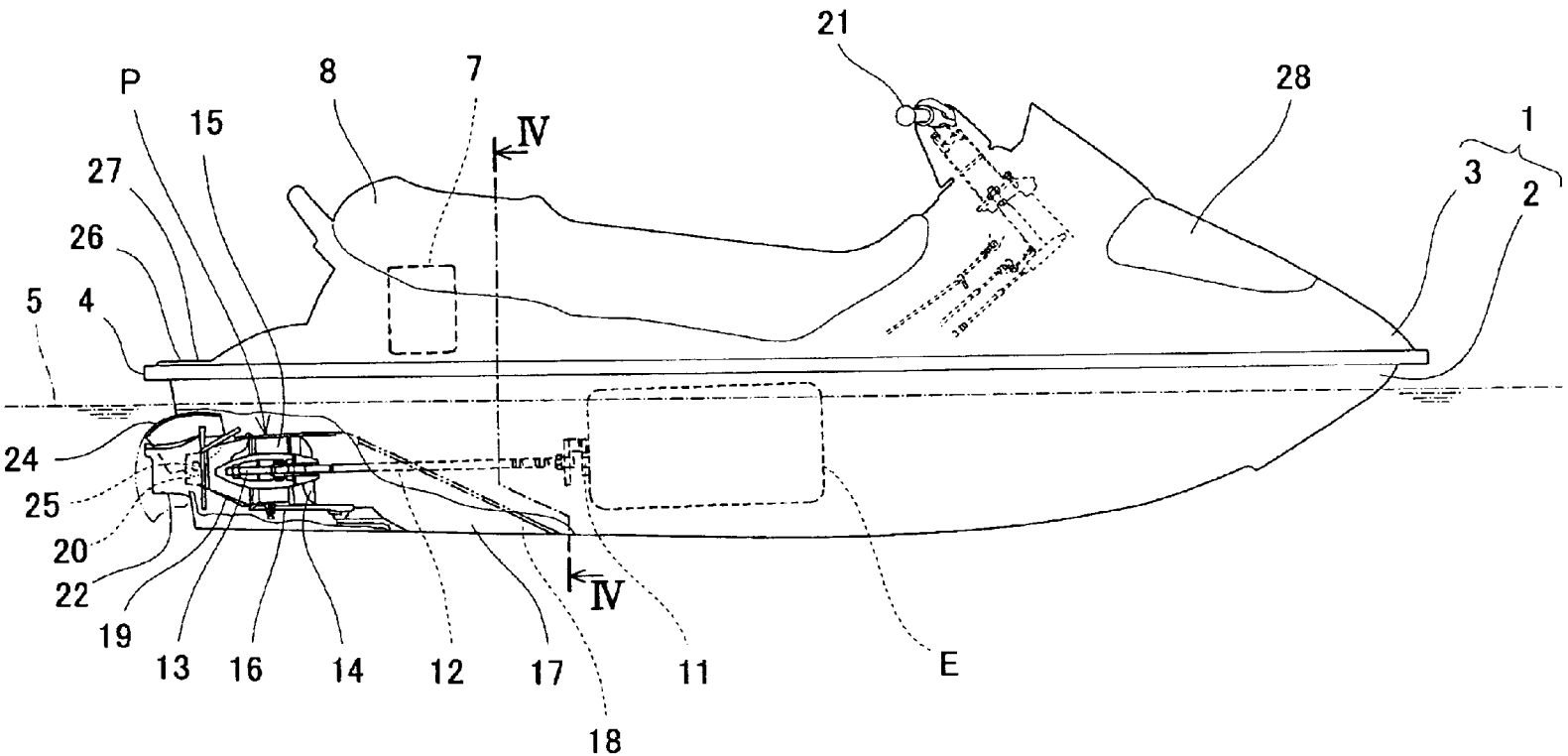
FIG. 1 is a side view of a personal watercraft according to an embodiment of the present invention.

Hereinafter, embodiments of a personal watercraft of the present invention will be described with reference to drawings. The personal watercraft in FIG. 1 is a straddle-type personal watercraft provided with a seat straddled by a rider. In the watercraft in FIG. 1, a body 1 comprises a hull 2 and a deck 3 covering the hull 2 from above. A line at which the hull 2 and the deck 3 are connected over the entire perimeter thereof is called a gunnel line 4. The gunnel line 4 is located above a waterline 5 of the watercraft.

Figure 2:
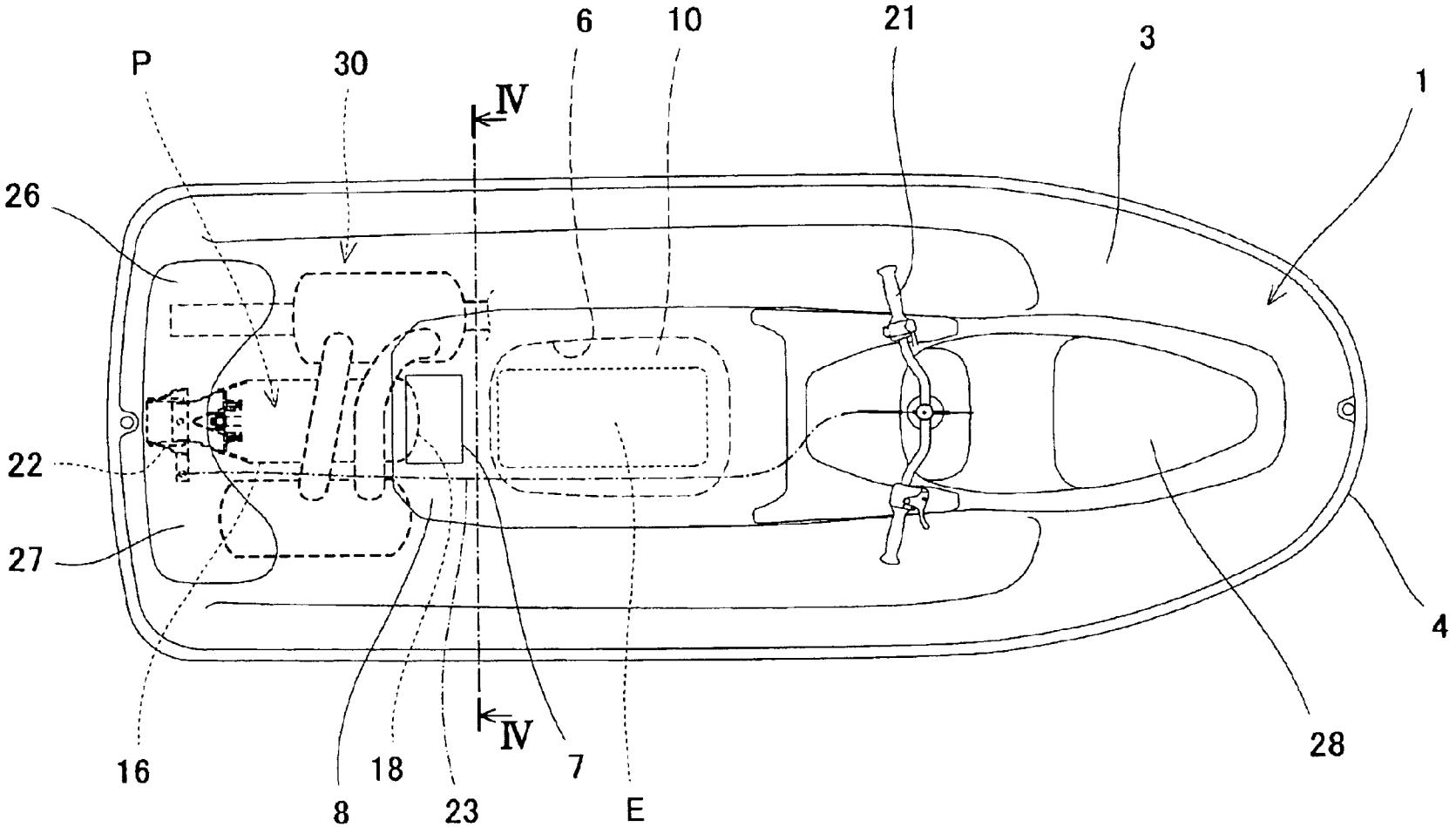
FIG. 2 is a plan view of the small watercraft in FIG. 1.

As shown in FIG. 2, an opening 6, which has a substantially rectangular shape as seen from above is formed at a substantially center section of the deck 3 in the upper portion of the body 1 such that its longitudinal direction corresponds with the longitudinal direction of the body 1. A rear storage box 7 is provided behind the opening 6 to store small articles or the like. A seat 8 is removably mounted over the opening 6 and the rear storage box 7.

An engine room 10 is provided in a space defined by the hull 2 and the deck 3 below the opening 6. An engine E for driving the personal watercraft is mounted within the engine room 10. The engine room 10 has a convex-shaped transverse cross-section and is configured such that its upper portion is smaller than its lower portion. In this embodiment, the engine E is an in-line four-cylinder four-cycle engine. As shown in FIG. 1, the engine E is mounted such that a crankshaft 11 extends along the longitudinal direction of the body 1.

An output end of the crankshaft 11 is rotatably coupled integrally with a pump shaft 13 of a water jet pump P provided on the rear side of the body 1 through a propeller shaft 12. An impeller 14 is attached on the pump shaft 13 of the water jet pump P. Fairing vanes 15 are provided behind the impeller 14. The impeller 14 is covered with a pump casing 16 on the outer periphery thereof.

A water intake 17 is provided on the bottom of the body 1. The water intake 17 is connected to the pump casing 16 through a water passage 18. The pump casing 16 is connected to a pump nozzle 19 provided on the rear side of the body 1. The pump nozzle 19 has a cross-sectional area that gradually reduces rearward, and an outlet port 20 is provided on the rear end of the pump nozzle 19.

As shown in FIG. 2, the water passage 18 and the water jet pump P are provided on a bottom of a rear portion of the hull 2 to extend along a substantially center axis of the watercraft in the longitudinal direction of the watercraft. An exhaust system 30 described later is formed within the hull 2 on both sides of the water passage 18 and the water jet pump P. The exhaust gas from the engine E is discharged from outside the watercraft through the exhaust system 30.

The impeller 14 pressurizes and accelerates the water sucked from the water intake 17 and fairing vanes 15 guide the water. The water is ejected rearward through the pump nozzle 19 and from the outlet port 20. As the resulting reaction, the watercraft obtains a propulsion force.

In FIGS. 1 and 2, reference numeral 21 denotes a bar-type steering handle. The steering handle 21 is connected to a steering nozzle 22 provided behind the pump nozzle 19 through a cable 23 (represented by a dashed line in FIG. 2). When the rider rotates the handle 21 clockwise or counterclockwise, the steering nozzle 22 is swung toward the opposite direction so that the ejection direction of the water being ejected through the pump nozzle 19 can be changed, and the watercraft can be correspondingly turned to any desired direction while the water jet pump P is generating the propulsion force.

As shown in FIG. 1, a bowl-shaped reverse deflector 24 is provided on the rear side of the body 1 so as to have the steering nozzle 22 inside the deflector 24 such that it can vertically swing around a horizontally mounted swinging shaft 25. The deflector 24 is swung downward to a lower position around the swinging shaft 25 to deflect the ejected water from the steering nozzle 22 forward, and, as the resulting reaction, the personal watercraft moves rearward.

In FIGS. 1 and 2, a rear deck 26 is provided in the rear section of the body 1. The rear deck 26 is provided with an openable rear hatch cover 27. A rear compartment (not shown) with a small capacity is provided under the rear hatch cover 27. In FIGS. 1 and 2, a front hatch cover 28 is provided in a front section of the body 1. A front compartment (not shown) is provided under the front hatch cover 28 for storing equipments and the like.

Embodiment 1

Subsequently, the exhaust system 30 including main components of the present invention will be described with reference to FIGS. 3 to 5.

Figure 3:
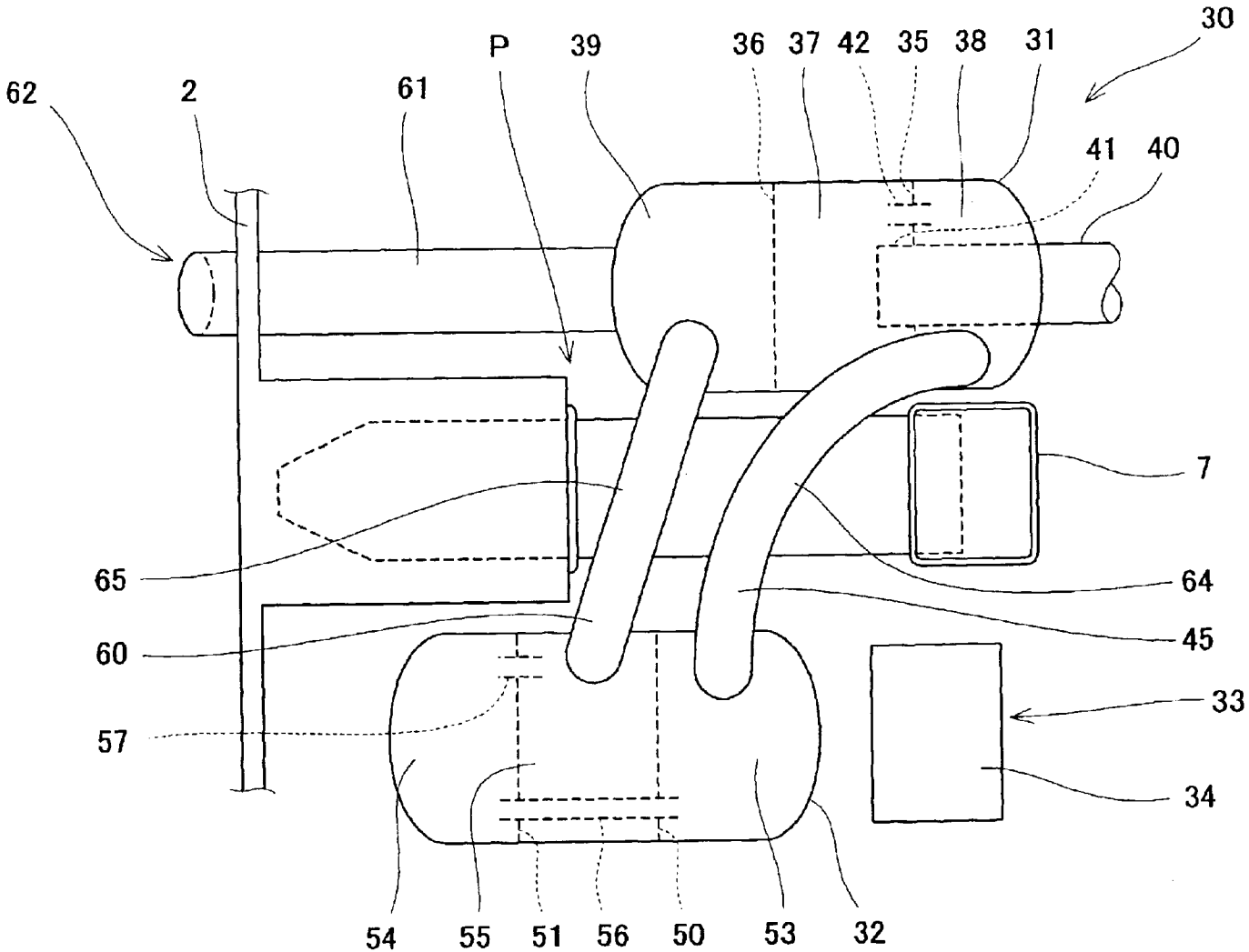
FIG. 3 is a plan view of an exhaust system according to a first embodiment of the present invention.

Turning now to FIG. 3, the exhaust system 30 has a first exhaust chamber 31 and a second exhaust chamber 32. Typically, the first exhaust chamber 31 and the second exhaust chamber 32 are entirely cylindrical and elongate in an axial direction thereof. Both ends of each of the first and second exhaust chambers 31 and 32 are closed. The first exhaust chamber 31 is located on the left side of the water jet pump P such that its axis extends along the longitudinal direction of the watercraft (see FIG. 2). The second exhaust chamber 32 is located on the right side of the water jet pump P such that its axis extends along the longitudinal direction of the watercraft (see FIG. 2). Alternatively, the first and second exhaust chambers 31 and 32 may be tubular with polygonal and or non-cylindrically curved cross-sections when sectioned along the direction perpendicular to their axes.

The second exhaust chamber 32 is disposed such that its front end is located behind a front end of the first exhaust chamber 31. Therefore, there is a space 33 forward of the second exhaust chamber 32. Within the space 33, a battery 34 is disposed. Alternatively or in addition to battery 34, other components may be disposed as necessary. Further, it will be appreciated that the space 33 may be omitted.

An inner space of the first exhaust chamber 31 is divided into three parts defined by separating walls 35 and 36. More specifically, the inner space of the first exhaust chamber 31 has a first space 37 located at the center to allow the exhaust gas from the engine E to flow therein, a second space 38 located at the front, and a sixth space 39 located at the rear to allow the exhaust gas from the second exhaust chamber 32 to flow therein.

An upstream end portion of a first exhaust pipe 40 is connected to an exhaust port (not shown) of the engine E. A downstream end portion 41 of the first exhaust pipe 40 penetrates through the front end of the first exhaust chamber 31 and extends within the second space 38. The downstream end portion 41 further penetrates through the separating wall 35 to protrude into the first space 37 located at the center. The first space 37 and the second space 38 communicate with each other through a pipe 42 penetrating through the separating wall 35. The first space 37 and the sixth space 39 are defined by the separating wall 36.

Figure 4:
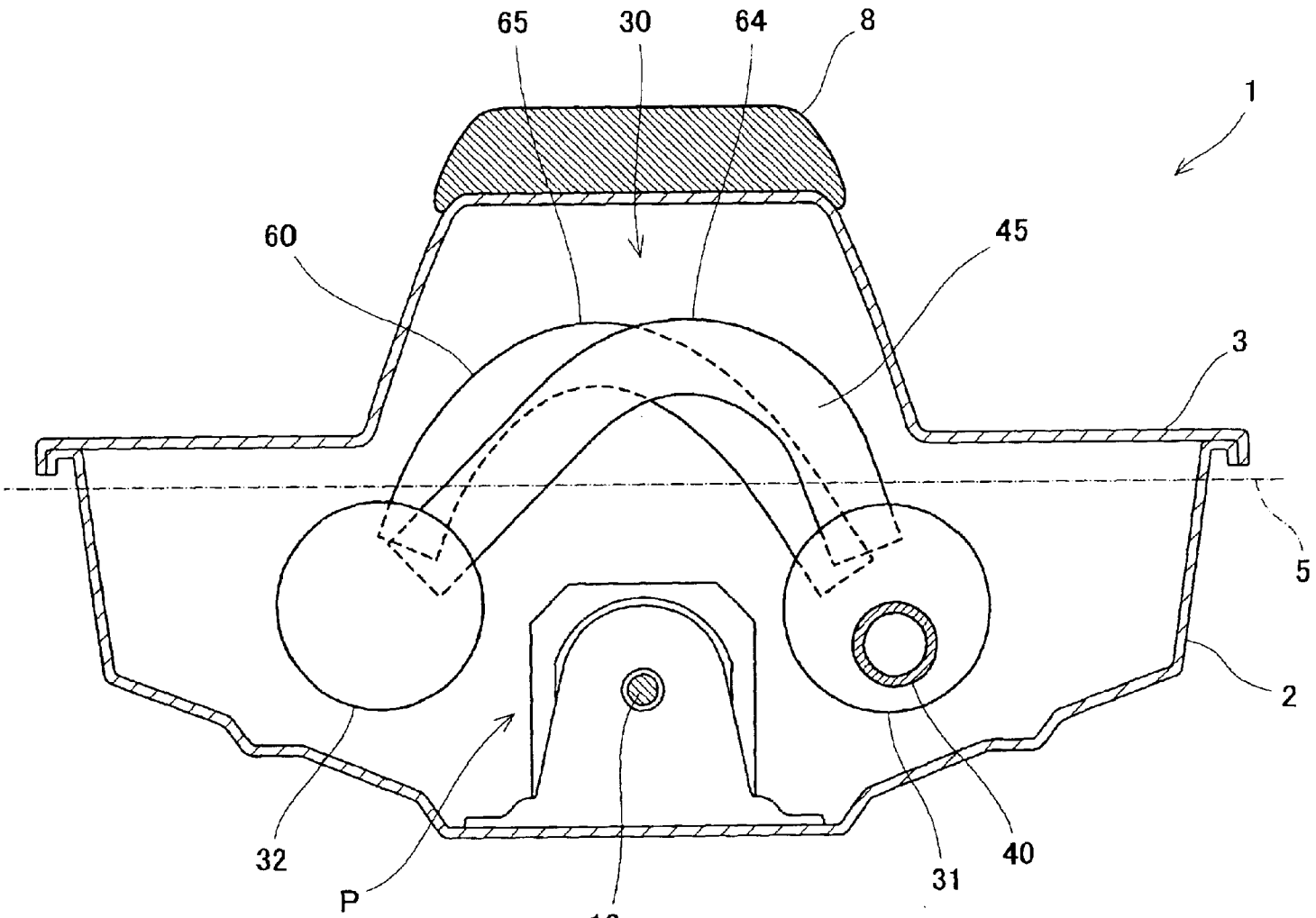
FIG. 4 is a cross-sectional view taken in the direction of arrows along line IV—IV of the personal watercraft in FIG. 1.

As shown in FIG. 4, a first inverted-U shaped pipe 45 is provided over the water jet pump P. The first inverted-U shaped pipe 45 is bent at a position thereof in the flow path of the exhaust gas to be substantially inverted-U shaped. An upstream end portion of the first inverted-U shaped pipe 45 is connected to a peripheral portion of the first exhaust chamber 31 to protrude into an inside thereof and to communicate with the second space 38 (see FIG. 3). A downstream end portion of the first inverted-U shaped pipe 45 is connected to the second exhaust chamber 32.

As shown in FIG. 3, an inner space of the second exhaust chamber 32 is divided into three parts defined by separating walls 50 and 51. More specifically, the inner space of the second exhaust chamber 32 has a third space 53 located at the front, a fourth space 54 located at the rear, and a fifth space 55 located at the center, within which the exhaust gas flows in successive order.

As shown in FIG. 4, a downstream end portion of the first inverted-U shaped pipe 45 is connected to a peripheral portion of the second exhaust chamber 32 to protrude into an inside thereof and to communicate with the third space 53 of the second exhaust chamber 32 (see FIG. 3). As shown in FIG. 3, the third space 53 and the fourth space 54 communicate with each other through a pipe 56 penetrating through the separating walls 50 and 51 and extending through the fifth space 55 located between them. The fourth space 54 and the fifth space 55 communicate with each other through a pipe 57 penetrating through the separating wall 51.

As shown in FIG. 4, a second inverted-U shaped pipe 60 is provided over the water jet pump P. The second inverted-U shaped pipe 60 is bent at a position thereof in the flow path of the exhaust gas to be substantially inverted-U shaped. An upstream end portion of the second inverted-U shaped pipe 60 is connected to a peripheral portion of the second exhaust chamber 32 to protrude into an inside thereof and to communicate with the fifth space 55 of the second exhaust chamber 32 (see FIG. 3). A downstream end portion of the second inverted-U shaped pipe 60 is connected to the peripheral portion of the first exhaust chamber 31 to protrude into the inside thereof and to communicate with the sixth space 39 provided on the rear side of the first exhaust chamber 31 (see FIG. 3).

As shown in FIG. 3, a second exhaust pipe 61 extends rearward from the rear portion of the first exhaust chamber 31. Through the second exhaust pipe 61, the sixth space 39 of the first exhaust chamber 31 communicates with the outside of the watercraft on the rear side of the body 1. A rear end portion of the second exhaust pipe 61 forms an exhaust outlet 62 of the exhaust system 30.

Figure 5:
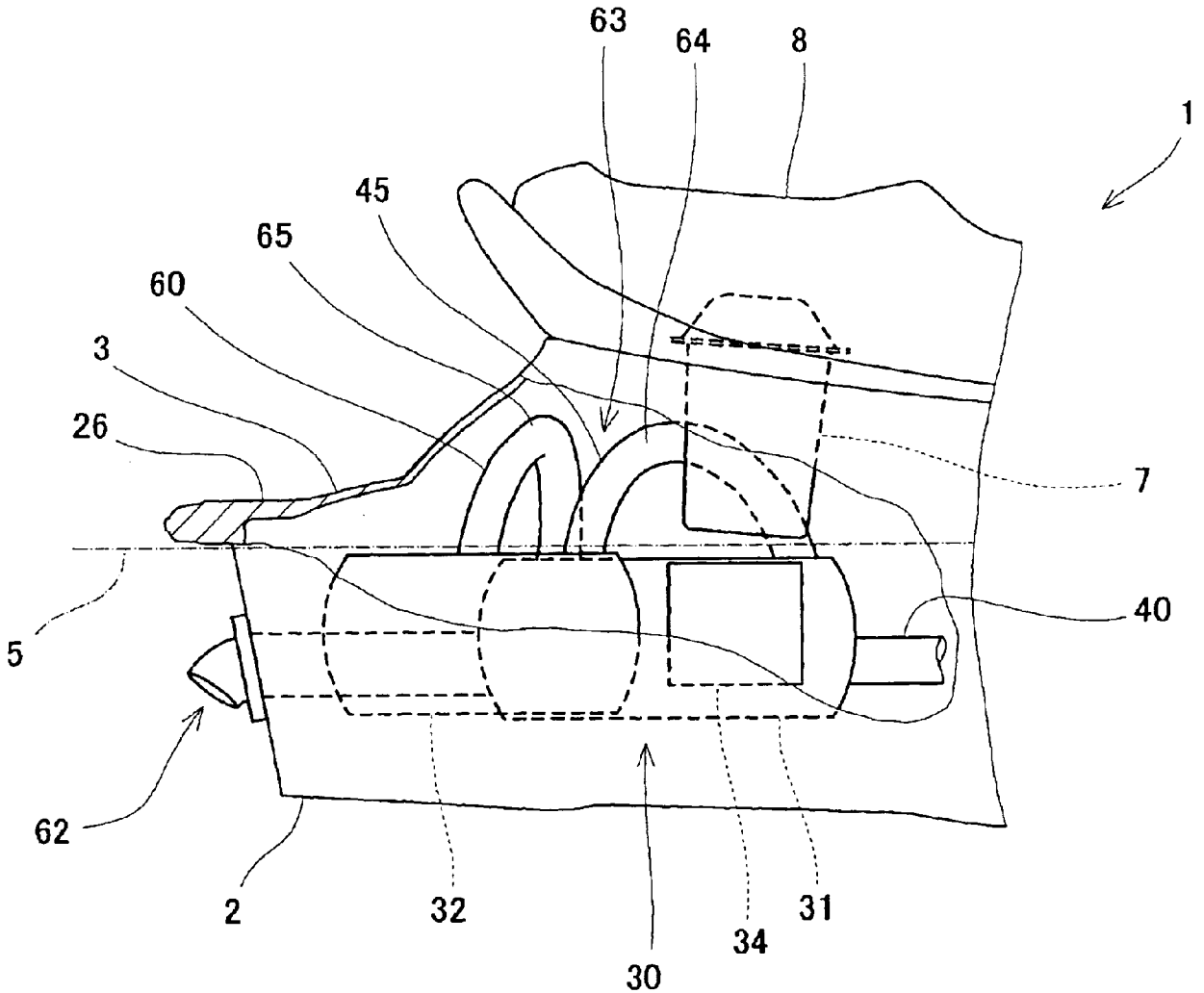
FIG. 5 is a partial cross-sectional view of a rear portion of the personal watercraft in FIG. 1, showing a configuration of the exhaust system in FIG. 3, as seen from a right side.

As shown in FIG. 5, a portion of the deck 3 between the rear deck 26 and the storage box 7 is sloped. A rear space 63 is formed within a portion of the deck 3 between the rear deck 26 and the storage box 7. The first inverted-U shaped pipe 45 and the second inverted U-shaped pipe 60 pass through the rear space 63.

The rear space 63 is located above the waterline 5. As shown in FIGS. 4 and 5, an uppermost portion 64 of the first inverted-U shaped pipe 45 and an uppermost portion 65 of the second inverted-U shaped pipe 60 are each located above the waterline 5.

In the exhaust system 30 of the personal watercraft, the exhaust gas from the engine E flows as described below. The exhaust gas flows from the first exhaust pipe 40 into the first space 37 of the first exhaust chamber 31 and then into the second space 38 of the first exhaust chamber 31. Then, the exhaust gas flows from the second space 38 into the third space 53 of the second exhaust chamber 32 through the first inverted-U shaped pipe 45. The exhaust gas flows from the third space 53 into the fourth space 54 and then into the fifth space 55. Further, the exhaust gas flows from the fifth space 55 into the sixth space 39 at the rear portion of the first exhaust chamber 31 through the second inverted-U shaped pipe 60. The exhaust gas flows from the sixth space 39 through the second exhaust pipe 61 and is discharged outside the body 1 through the exhaust outlet 62. While the exhaust gas from the engine E is flowing through the inner spaces of the first exhaust chamber 31 and the inner spaces of the second exhaust chamber 32 in the exhaust system 30, its energy is reduced, and the resulting exhaust gas is discharged outside the body 1.

In the exhaust system 30 configured as described above, the sixth space 39 of the first exhaust chamber 31 is provided at a position in the flow path of the exhaust gas from the second exhaust chamber 32 to the exhaust outlet 62, and the second inverted-U shaped pipe 60 is provided between the sixth space 39 and the second exhaust chamber 32. When the watercraft is at rest on the water with the engine E being in a stopped state, the exhaust outlet 62 is submerged and water flows into the sixth space 39 through the exhaust outlet 62, but, the water is inhibited from flowing into the second exhaust chamber 32 located on upstream side through the second inverted-U shaped pipe 60, because the uppermost portion 65 of the second inverted-U shaped pipe 60 is located higher than the waterline 5.

In addition, according to a construction in which the downstream end portion of the second inverted-U shaped pipe 60 protrudes into the sixth space 39, the water within the sixth space 39 is inhibited from flowing up from the downstream end portion of the second inverted-U shaped pipe 60 into the second inverted-U shaped pipe 60 even when the body 1 is inclined. Thus, the water is reliably inhibited from flowing into the second exhaust chamber 32.

Even if the water flows into the second exhaust chamber 32, the water within the second exhaust chamber 32 is inhibited from flowing to upstream side through the uppermost portion 64, because the second exhaust chamber 32 is connected to the first exhaust chamber 31 through the first inverted-U shaped pipe 45 with the uppermost portion 64 located higher than the waterline 5. Thus, entry of water into the first exhaust chamber 31 is inhibited.

In addition, in the structure in which the downstream end portion of the first inverted-U shaped pipe 45 protrudes into the third space 53 of the second exhaust chamber 32, the water within the third space 53 is inhibited from flowing up from the downstream end portion of the first inverted-U shaped pipe 45 into the first inverted-U shaped pipe 45 even when the body 1 is inclined. Thus, entry of the water into the first exhaust chamber 31 is reliably inhibited.

Further, when the body 1 is inverted, the uppermost portion 65 of the second inverted-U shaped pipe 60 is located lower than the second exhaust chamber 32, but the exhaust outlet 62 is located higher than the waterline 5. Under this condition, the water is inhibited from entering through the exhaust outlet 62, and, hence, the water is inhibited from flowing from the second inverted-U shaped pipe 60 into the second exhaust chamber 32.

Even if the water flows into the second inverted-U shaped pipe 60, the body 1 is rotated clockwise as seen from behind to be returned to its initial posture. Thereby, the water within the second inverted-U shaped pipe 60 flows toward the exhaust outlet 62. Thus, entry of the water into the second exhaust chamber 32 is inhibited.

On the other hand, when the body 1 is rotated counterclockwise as seen from behind to be returned to its initial posture, the water within the second inverted-U shaped pipe 60 might flow into the second exhaust chamber 32, but the water within the second exhaust chamber 32 does not flow into the first exhaust chamber 31 through the first inverted-U shaped pipe 44. So, by rotating the body 1 in an inverted state either clockwise or counterclockwise to be returned to its initial posture, the water is inhibited from flowing into the engine E through the exhaust system 30.

In accordance with the exhaust system 30 according to the embodiment, entry of the water into the first exhaust chamber 31 and the second exhaust chamber 32 is well inhibited. The configuration of the first exhaust chamber 31 and the configuration of the second exhaust chamber 32 are not intended to be limited to those shown in FIG. 3, but other configurations may be adopted in view of muffling effects or the like.

Embodiment 2

Figure 6:
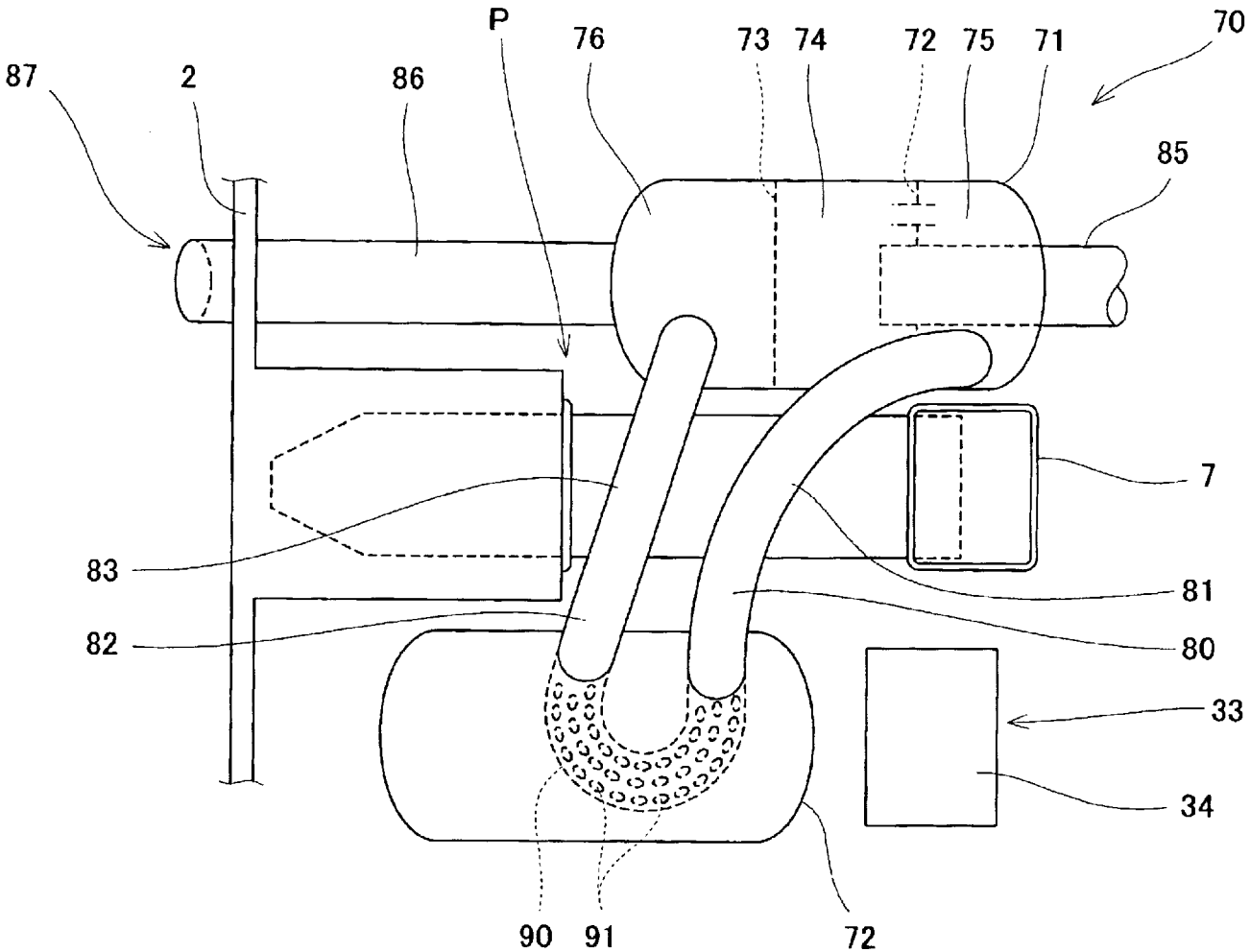
FIG. 6 is a plan view of an exhaust system according to a second embodiment of the present invention.

An exhaust system 70 having another configuration will be described with reference to FIG. 6. As in the exhaust system 30 described in the first embodiment, the exhaust system 70 has a first exhaust chamber 71 and a second exhaust chamber 72 which are arranged within the body 1 as in the first embodiment.

As in the first exhaust chamber 31 of the exhaust system 30, an inner space of the first exhaust chamber 31 is divided into a first space 74 located at the center, a second space 75 located at the front, and a third space 76 located at the rear, which are defined by separating walls 72 and 73. The second exhaust chamber 72 is different from the second exhaust chamber 32 of the exhaust system 30 in that the second exhaust chamber 72 has a single space and functions as a resonator as described later.

As in the exhaust system 30, a first inverted-U shaped pipe 80 is provided over the water jet pump P. The first inverted-U shaped pipe 80 is bent at a position in the flow path of the exhaust gas to be substantially inverted-U shaped. An upstream end portion of the first inverted-U shaped pipe 80 is connected to a peripheral portion of the first exhaust chamber 71 to communicate with the second space 75. A downstream end portion of the first inverted-U shaped pipe 80 is connected to the second exhaust chamber 72. As in the first embodiment, an uppermost portion 81 of the first inverted-U shaped pipe 80 is located above the waterline 5 (see FIG. 1) of the body 1.

A second inverted-U shaped pipe 82 is provided behind the first inverted-U shaped pipe 80 and over the water jet pump P. The second inverted-U shaped pipe 82 is bent at a position thereof in the flow path of the exhaust gas to be substantially inverted-U shaped. An upstream end portion of the second inverted-U shaped pipe 82 is connected to a peripheral portion of the second exhaust chamber 72 and a downstream end portion of the second inverted-U shaped pipe 82 is connected to a peripheral portion of the first exhaust chamber 71 to communicate with the third space 76. As in the first embodiment, an uppermost portion 83 of the second inverted-U shaped pipe 82 is located above the waterline 5 (see FIG. 1) of the body 1.

The exhaust port (not shown) of the engine E communicates with the first space 74 of the first exhaust chamber 71 through a first exhaust pipe 85 having a structure similar to that of the first exhaust pipe 40 in the first embodiment. The third space 76 of the first exhaust chamber 71 communicates with the outside of the body 1 through a second exhaust pipe 86 having a structure similar to that of the second exhaust pipe 40 of the first embodiment. A downstream end portion of the second exhaust pipe 86 forms an exhaust outlet 87 of the exhaust system 70.

The first inverted-U shaped pipe 80 and the second inverted-U shaped pipe 82 communicate with each other through a connecting pipe 90 within the second exhaust chamber 72. The connecting pipe 90 is provided with a number of penetrating holes 91 formed on a periphery thereof to permit the exhaust gas to flow into an inside or to an outside of the connecting pipe 90. The exhaust system 70 of the second embodiment is applied to the personal watercraft in the same manner as described in the first embodiment.

In the exhaust system 70, while the exhaust gas from the engine E is flowing from the first exhaust pipe 85 into the first space 74 of the first exhaust chamber 71 and then into the second space 75, its energy is reduced. The exhaust gas flows from the second space 75 into the connecting pipe 90 within the second exhaust chamber 72 through the first inverted-U shaped pipe 80. While the exhaust gas is flowing within the connecting pipe 90, the exhaust gas flows into the inside or to the outside of the pipe 90 through the penetrating holes 91, thereby causing the exhaust noise to be reduced. As should be appreciated from this, the second exhaust chamber 72 functions as a resonator. The exhaust gas with the exhaust noise reduced within the second exhaust chamber 72 flows from the second exhaust chamber 72 into the third space 76 of the first exhaust chamber 71 through the second inverted-U shaped pipe 82. Within the third space 76, the energy of the exhaust gas is further reduced. The resulting exhaust gas flows through the second exhaust pipe 86 and is discharged outside the body 1 through the exhaust outlet 87.

In the exhaust system 70 so configured, entry of water into the second exhaust chamber 72, the first exhaust chamber 71, and the engine E can be inhibited when the watercraft is at rest or inverted as in the first embodiment, and the exhaust noise can be reduced.

Instead of the second exhaust chamber 72, the first exhaust chamber 71 may function as the resonator. The structure of the resonator is not intended to be limited to that of the second exhaust chamber 72 in FIG. 6, but other structures may be adopted in view of a muffling effect, or the like.

The exhaust systems 30 and 70 described in the first and second embodiments may be respectively provided with valves for inhibiting reverse flow to inhibit entry of water into the engine E.

Figure 7:
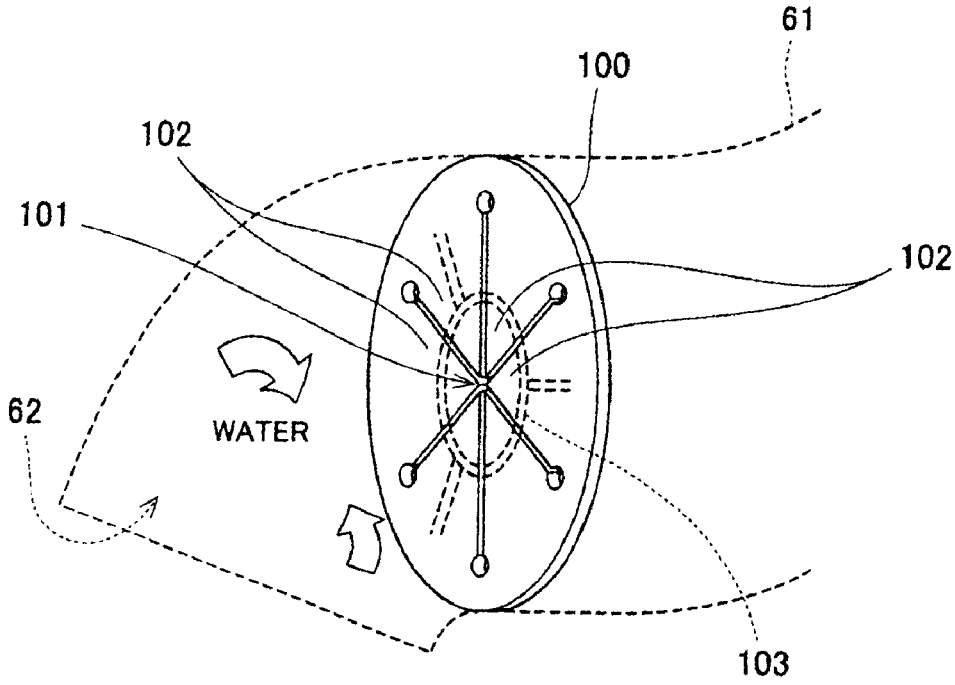
FIG. 7 is a perspective view of a structure of a valve provided in the exhaust system.

A valve 100 for inhibiting reverse flow in FIG. 7 is provided within the second exhaust pipe 61 in the vicinity of the exhaust outlet 62. The valve 100 is made of flexible synthetic resin and is circular-plate shaped. The valve 100 is provided with a plurality of cuts extending radially from a center 101. In other words, the valve 100 is provided with a plurality of triangular pieces 102 with apexes located substantially at the center 101. A ring-shaped stop member 103 is provided on upstream side of the valve 100 to be close to and concentric with the valve 100.

Figure 8:
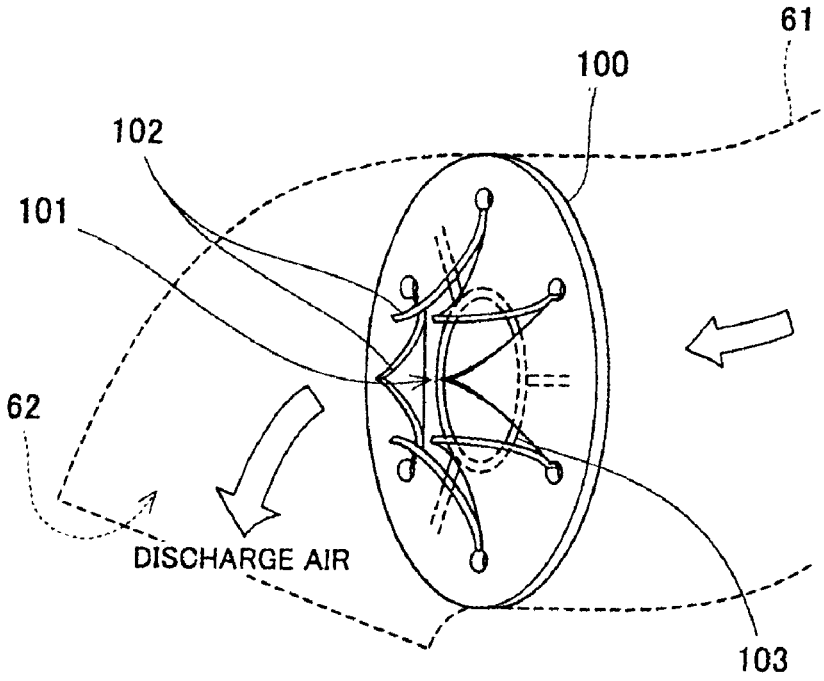
FIG. 8 is a perspective view of an operation of the valve provided in the exhaust system.

As shown in FIG. 8, when the triangular pieces 102 of the valve 100 are moved to cause their apexes to move toward downstream side in the flow path of the exhaust gas, an opening is formed at the center 101. However, as shown in FIG. 7, the apexes of the triangular pieces 102 are inhibited from moving toward the upstream side in the flow path of the exhaust gas because of the presence of the stop member 103.

As shown in FIG. 8, the exhaust gas from the engine E flows toward downstream side through the valve 100 and is discharged outside the body 1, whereas the water outside the body 1 is inhibited from flowing into the body 1 through the second exhaust pipe 61 because of the presence of the valve 100. In addition, the exhaust noise can be reduced.

The valve 100 is applicable to the exhaust system 70 of the second embodiment in the same manner that the valve 100 is applied to the first exhaust system 30 of the first embodiment, and similar function and effects are obtained. The valve 100 typically is not intended to be provided in the vicinity of the exhaust outlet 62, but may be provided at other suitable locations, for example, a connecting end portion of the second inverted-U shaped pipe 60 connected to the second exhaust chamber 32 in the exhaust system 30.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalents of such metes and bounds thereof are therefore intended to be embraced by the claims.

What is claimed is:

1. A personal watercraft comprising:

a body including a hull and a deck;

an engine mounted within the body;

a first exhaust chamber disposed on one side of the body, the first exhaust chamber having a plurality of inner spaces defined by at least one separating wall to allow an exhaust gas from the engine to flow within the inner spaces;

a second exhaust chamber disposed on an opposite side of the body to allow the exhaust gas from the first exhaust chamber to flow within the second exhaust chamber;

a first exhaust pipe through which the engine and the first exhaust chamber communicate with each other, such that the exhaust gas from the engine is drawn into one of the inner spaces of the first exhaust chamber through the first exhaust pipe;

a first inverted-U shaped pipe configured to extend from the first exhaust chamber to the second exhaust chamber such that the exhaust gas drawn into the first exhaust chamber through the first exhaust pipe is drawn from the first exhaust chamber to the second exhaust chamber through the first inverted-U shaped pipe;

a second inverted-U shaped pipe configured to extend from the second exhaust chamber to the first exhaust chamber such that the exhaust gas drawn into the second exhaust chamber through the first inverted-U shaped pipe is drawn from the second exhaust chamber into another one of the inner spaces of the first exhaust chamber through the second inverted-U shaped pipe; and a second exhaust pipe configured to extend from the first exhaust chamber to an outside of the body such that the exhaust gas drawn into the first exhaust chamber through the second inverted-U shaped pipe is drawn from the first exhaust chamber to the outside of the body through the second exhaust pipe;

wherein the first inverted-U shaped pipe and the second inverted-U shaped pipe are each positioned in a flow path of the exhaust gas and bent to be substantially inverted-U shaped.

2. The personal watercraft according to claim 1, wherein the second inverted-U shaped pipe is connected to the first exhaust chamber so as to protrude into the other one of the inner spaces of the first exhaust chamber.

3. The personal watercraft according to claim 1, wherein an uppermost portion of the first inverted-U shaped pipe and an uppermost portion of the second inverted-U shaped pipe are each located higher than a waterline of the body of the watercraft.

4. The personal watercraft according to claim 3, wherein the first inverted-U shaped pipe and the second inverted-U shaped pipe are provided to extend in a space within the body which is formed above a joint portion where the hull and the deck are joined to each other.

5. The personal watercraft according to claim 4, wherein the personal watercraft is a straddle-type watercraft provided with a seat straddled by a rider, the personal watercraft further comprising:

a rear deck formed at a rear portion of the body; and a storage box disposed forward of the rear deck and under the seat, wherein the space within the body is located between the rear deck and the storage box.

6. The personal watercraft according to claim 1, wherein the first exhaust chamber and the second exhaust chamber are each comprised of a cylindrical member with a center axis thereof extending in a longitudinal direction of the body.

7. The personal watercraft according to claim 6, wherein the first exhaust chamber and the second exhaust chamber are connected at peripheral portions thereof to the first inverted-U shaped pipe and the second inverted-U shaped pipe, respectively.

8. The personal watercraft according to claim 1, wherein at least one of the first exhaust chamber and the second exhaust chamber forms a resonator.

9. The personal watercraft according to claim 1, wherein a front end of the second exhaust chamber is located behind a front end of the first exhaust chamber within the body.

10. The personal watercraft according to claim 9, wherein a battery is disposed forward of the second exhaust chamber.

11. The personal watercraft according to claim 1, further comprising:

a water jet pump driven by the engine;

wherein the water jet pump is disposed on a substantially center axis of the body to extend along a longitudinal direction of the body, and the first exhaust chamber and the second exhaust chamber are disposed on right and left sides of the water jet pump, respectively.

12. The personal watercraft according to claim 1, wherein a valve for inhibiting reverse flow is provided in the second exhaust pipe.

* * * * *